US007637736B1

(12) United States Patent
Yang

(10) Patent No.: US 7,637,736 B1
(45) Date of Patent: Dec. 29, 2009

(54) LIGHTER

(75) Inventor: Wu Xiao Yang, Wenzhou (CN)

(73) Assignee: Mont D'or of America, LLC, New York, NY (US)

( * ) Notice: Subject to any disclaimer, the term of this patent is extended or adjusted under 35 U.S.C. 154(b) by 125 days.

(21) Appl. No.: 11/789,562

(22) Filed: Apr. 25, 2007

(51) Int. Cl.
*F23Q 2/08* (2006.01)

(52) U.S. Cl. ..... 431/131; 431/253; 431/254; 431/255; 431/277; 431/344

(58) Field of Classification Search ..... 431/131, 431/253, 254, 255, 277, 344
See application file for complete search history.

(56) References Cited

U.S. PATENT DOCUMENTS

| | | | | | |
|---|---|---|---|---|---|
| 1,704,091 | A | * | 3/1929 | Lozoff | 431/277 |
| 3,711,240 | A | * | 1/1973 | Warshaw | 431/253 |
| 4,538,983 | A | * | 9/1985 | Zeller et al. | 431/255 |
| 4,610,624 | A | * | 9/1986 | Bruhn | 431/255 |
| 5,199,865 | A | * | 4/1993 | Liang | 431/255 |
| 5,369,556 | A | * | 11/1994 | Zeller | 431/344 |
| D382,441 | S | * | 8/1997 | Ferrara, Jr. | D7/416 |
| 6,099,300 | A | * | 8/2000 | Rice | 431/255 |
| D441,605 | S | * | 5/2001 | Tubby et al. | D7/416 |
| D441,606 | S | * | 5/2001 | Tubby et al. | D7/416 |
| D442,828 | S | * | 5/2001 | Tubby et al. | D7/416 |
| D454,277 | S | * | 3/2002 | Chevalier | D7/416 |
| D462,235 | S | * | 9/2002 | Chevalier et al. | D7/416 |
| D464,848 | S | * | 10/2002 | Chevalier et al. | D7/416 |
| 6,648,630 | B2 | * | 11/2003 | Tse | 431/153 |
| 6,659,763 | B2 | * | 12/2003 | Fisher | 431/131 |
| 6,916,171 | B2 | * | 7/2005 | Adams et al. | 431/153 |
| 6,997,702 | B1 | * | 2/2006 | Chen | 431/344 |
| 2003/0108836 | A1 | * | 6/2003 | Fisher | 431/131 |

FOREIGN PATENT DOCUMENTS

| | | | |
|---|---|---|---|
| EP | 660045 | A2 * | 6/1995 |

* cited by examiner

*Primary Examiner*—Kenneth B Rinehart
*Assistant Examiner*—Jorge Pereiro
(74) *Attorney, Agent, or Firm*—Notaro & Michalos P.C.

(57) ABSTRACT

A lighter having a housing that contains a fluid reservoir and an ignition member; an actuation switch that is disposed on the housing; and a nozzle assembly that includes a nozzle head and a flexible support tube that supports the nozzle head at its distal end. The flexible support tube extends from the housing through a housing port. The flexible support tube has a nested position in which it is disposed within the housing and an extended position in which the flexible support tube extends from the housing through the port enabling the flexible support tube to be bent in multiple directions for directing the nozzle head.

15 Claims, 6 Drawing Sheets

LIGHTER

TECHNICAL FIELD

The present invention relates in general to lighters and more particularly to hand held lighters that may be used to light cigars, cigarettes or pipes.

BACKGROUND OF THE INVENTION

There are a variety of different types and styles of lighters that are typically referred to as cigarette or cigar lighters. Examples of lighters are found in, for example, U.S. Pat. Nos. 6,152,725 to Lee and 6,632,082 to Smith. Although these lighters are effective for the lighting of cigars or cigarettes they are not as effective for lighting a pipe where is advisable to direct the flame downwardly into the pipe bowl. Accordingly, an objective of the present invention is to provide an improved lighter construction that, although useable for lighting cigars and cigarettes, is particularly adapted for lighting pipes.

SUMMARY OF THE INVENTION

To accomplish the objective of the present invention there is provided a lighter construction that comprises a housing that contains a fluid reservoir; a nozzle member that includes a nozzle head; a valve that selectively couples the fluid reservoir to the nozzle member; an actuation button on the housing and a flexible nozzle tube extendable from the housing and supporting at its distal end the nozzle head. The flexible nozzle tube has a nested position in which it is disposed within the housing and an extended position in which the flexible nozzle tube extends from the housing and thus enabling the flexible nozzle tube to be bent in multiple directions for directing the nozzle head in lighting.

In accordance with other aspects the lighter construction may include an ignition member disposed in the housing for generating a spark to ignite the fluid; the ignition member may include a piezoelectric device and a piezoelectric wire that couples from the piezoelectric device to the nozzle head; including an ignition member, with the actuation button operating the ignition member and valve to provide a flame at the nozzle; including a flame adjuster and a filler valve at the bottom of the housing; including an elongated guide within the housing for receiving the flexible nozzle tube; wherein the guide extends between the top and bottom of the housing and the nozzle head in its nested position is disposed adjacent to the actuation button; and wherein the nozzle tube comprises a flexible metal tube that is readily bendable through at least 180 degrees.

Another embodiment comprises a housing that contains a fluid reservoir and an ignition member; an actuation switch that is disposed on the housing; a nozzle assembly that includes a nozzle head and a flexible support tube that supports the nozzle head at its distal end; the flexible support tube extendable from the housing through a housing port; and the flexible support tube having a nested position in which it is disposed within the housing and an extended position in which the flexible support tube extends from the housing through the port enabling the flexible support tube to be bent in multiple directions for directing the nozzle head.

In accordance with still other aspects the lighter construction may include a valve that selectively couples the fluid reservoir to the nozzle assembly via a fuel line; wherein the actuation switch is operatively connected to both the fluid reservoir and the ignition member; wherein the ignition member includes a piezoelectric device and a piezoelectric wire that couples from the piezoelectric device to the nozzle head; including an elongated guide within the housing for receiving the flexible support tube; wherein the guide extends between the top and bottom of the housing and the nozzle head in its nested position is disposed adjacent to the actuation switch; and including a fuel line extending through the flexible support tube from the reservoir to the nozzle head and an ignition wire that extends through the flexible support tube from the ignition member to a location adjacent to the nozzle head to initiate a flame.

Another embodiment comprises a housing that contains a fluid reservoir and an ignition member; an actuation switch; a nozzle assembly that includes a nozzle head and a flexible support tube that supports the nozzle head at its distal end; and an elongated hollow guide within the housing for receiving the flexible support tube; the flexible support tube having a nested position in which it is disposed within the housing and an extended position in which the flexible support tube extends from the housing enabling the flexible support tube to be bent in multiple directions for directing the nozzle head.

In accordance with a further aspects the lighter construction may include a fuel line extending through the flexible support tube from the reservoir to the nozzle head and an ignition wire that extends through the flexible support tube from the ignition member to a location adjacent to the nozzle head to initiate a flame; wherein the actuation switch is disposed at a top of the housing and further including a port at the top of the housing adjacent to the actuation switch through which the flexible support tube is extendable; including a valve that selectively couples the fluid reservoir to the nozzle assembly via a fuel line; wherein the actuation switch is operatively connected to both the fluid reservoir and the ignition member, and wherein the ignition member includes a piezoelectric device and a piezoelectric wire that couples from the piezoelectric device to the nozzle head.

DESCRIPTION OF THE DRAWINGS

Numerous other features and advantages of the present invention are realized by a reading of the following detailed description taken in conjunction with the accompanying drawings, in which.

DETAILED DESCRIPTION

Reference is now made to the accompanying drawings for a preferred embodiment of the present invention. The lighter that is described herein may be used for lighting cigars, cigarettes or other items, but is particularly suited for lighting a pipe in that it is provided with an extendable support tube that allows the nozzle to be readily re-directed by being bent in multiple directions including a reversed direction. For the pipe application one can easily hold the lighter housing basically upright while at the same time bending the nozzle downwardly into the pipe bowl to facilitate a lighting of the pipe.

Figure 1:
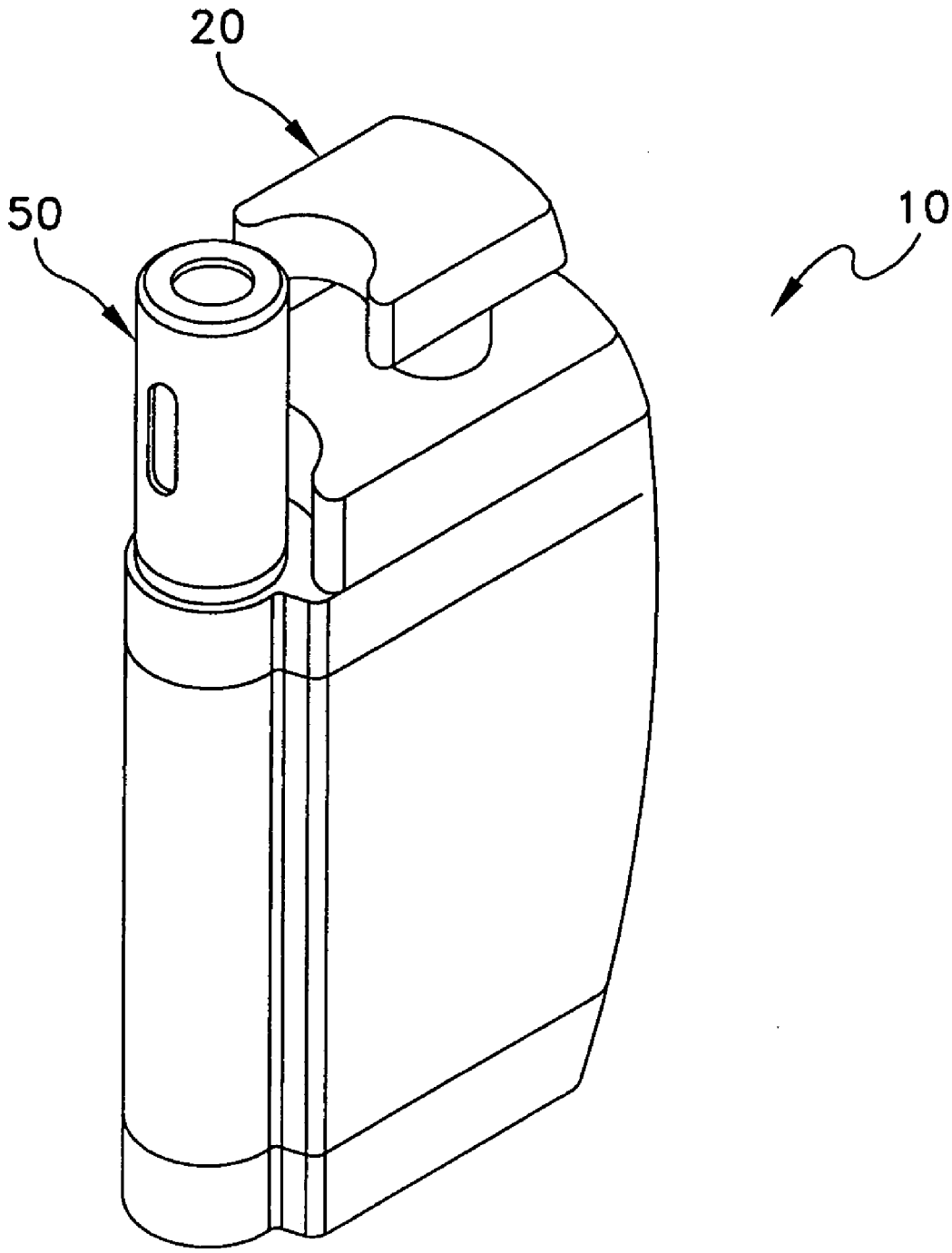
FIG. 1 is a perspective view of a preferred embodiment of the lighter construction of the present invention.
Figure 2:
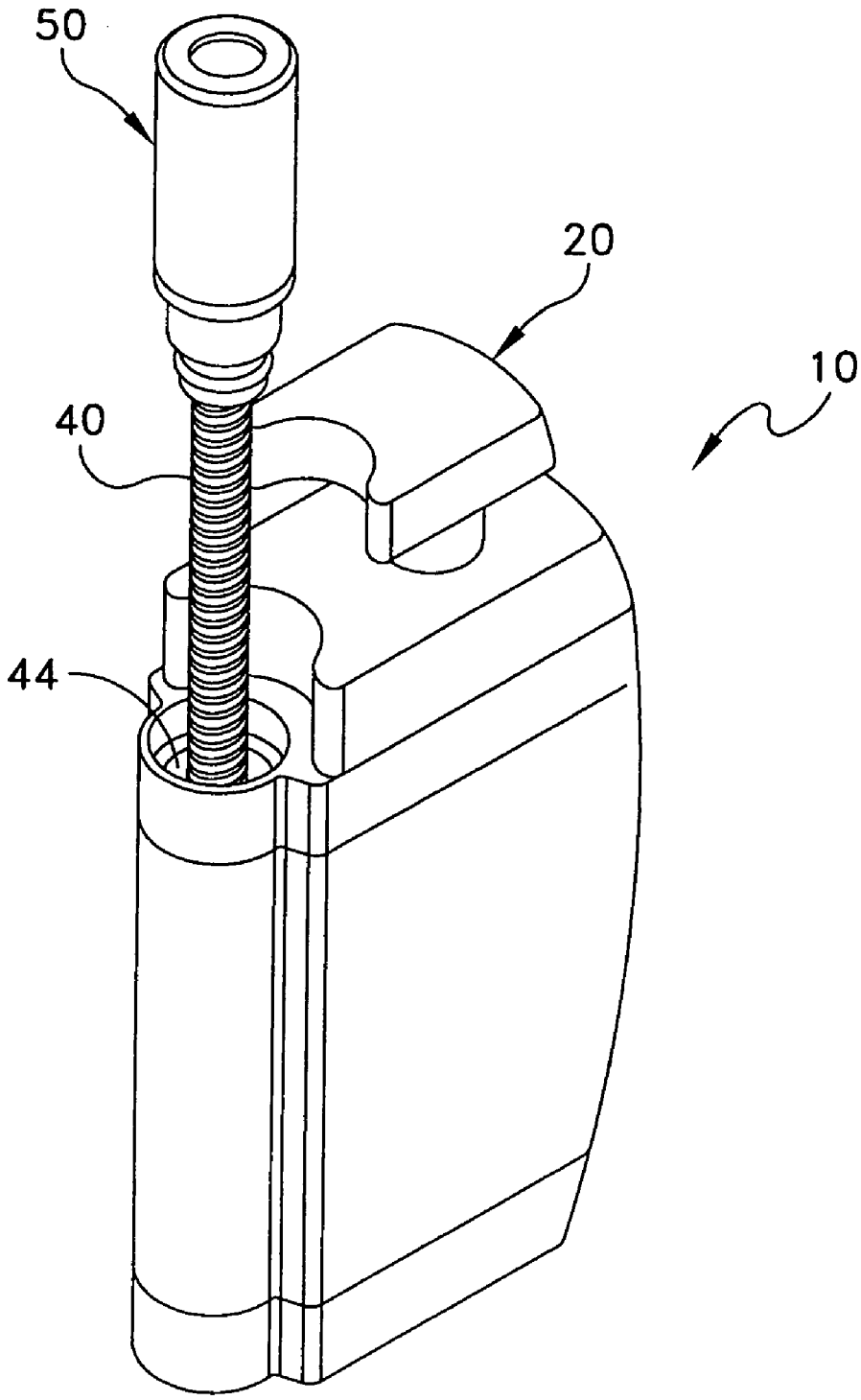
FIG. 2 is a perspective view of the same lighter of FIG. 1 with the nozzle extended.
Figure 3:
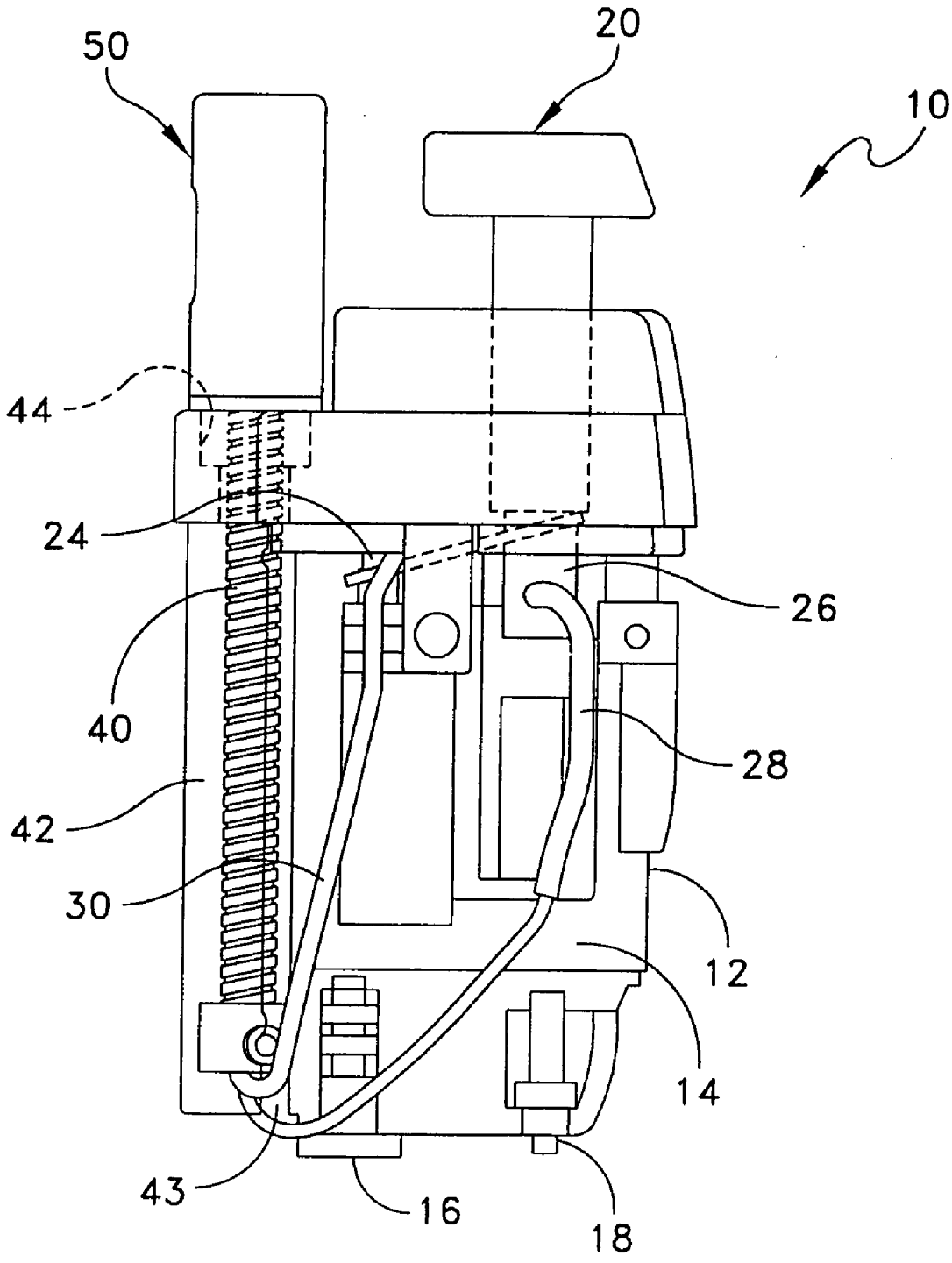
FIG. 3 is a schematic cross-sectional view of the lighter showing its various components and with the nozzle in its nested position.
Figure 4:
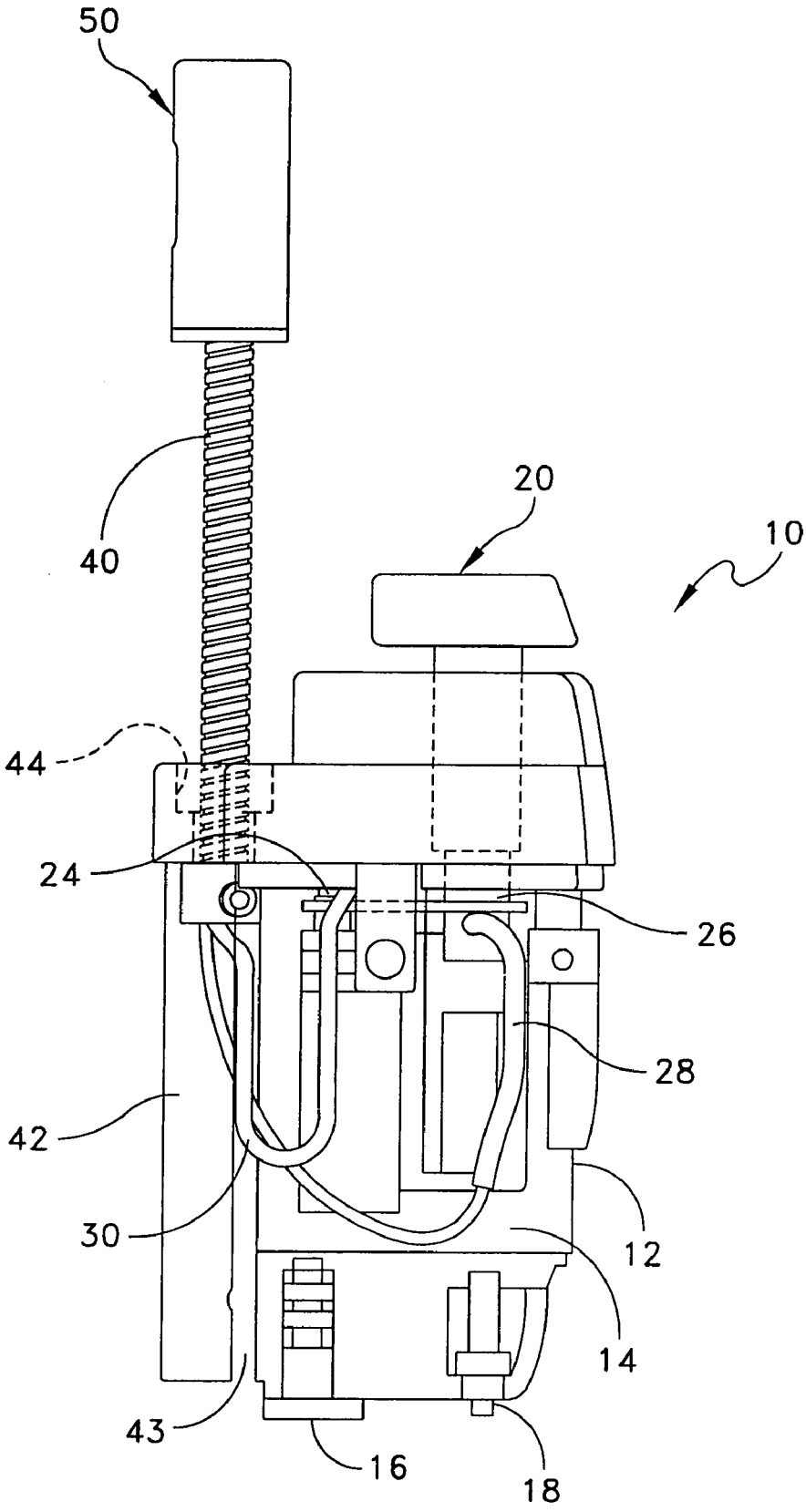
FIG. 4 is a schematic cross-sectional view of the lighter showing its various components and with the nozzle in its extended position.

To provide the improved operation of the present invention a flexible support tube 40 is provided that is adapted to extend from the housing and has supported at its distal end the nozzle head 50. The tube 40 is shown in the drawings in both an extended (FIGS. 2 and 4) and non-extended (FIGS. 1 and 3) position. The flexible support tube 40 is preferably made of metal, may be formed in separate sections that enable a flexing or bending action and is hollow through its length. The flexible support tube 40 has a nested position in which it is disposed within the housing 12 and an extended position in which the flexible support tube 40 extends from the housing enabling the flexible support tube to be bent in multiple directions for directing the nozzle head 50. Refer to the plan view of FIG. 6.

Referring to the drawings there is illustrated a lighter 10 according to the present invention which includes a housing 12. There may be a cap provided over the housing but such a cap is not show herein. The housing 12 may be constructed of metal and may be provided in multiple pieces that are secured together. Within a bottom part of the housing is disposed a fuel reservoir 14 that contains a standard lighter fluid fuel. A filler valve 18 is illustrated at the bottom wall of the housing. The lighter fluid is inserted through the filler valve 18. The bottom wall of the housing is also shown as having a flame adjuster 16.

The top of the housing supports an actuation button or switch 20. The actuation button 20 controls both an ignition member for generating a spark to ignite the fuel, and a valve for controlling the fuel flow from the reservoir. By depressing the button 20 the valve is opened and the ignition source is activated. The actuation button 20 is depressed to operate the lighter and has a biasing means (not shown) associated therewith to return the actuation button to its extended or upper position. Although the actuation button 20 is illustrated at the top of the housing it is understood that it could also be mounted at other locations of the housing such as at a sidewall of the housing.

As mentioned previously, there is provided an ignition member. This is shown in the drawings by the spark ignition mechanism or member 26 which is also disposed within the housing 12. The ignition member 26 is for generating a spark in close proximity to the nozzle head 50 upon actuation of the actuation button or switch 20, as will be described in greater detail below. An ignition wire 28 extends from the ignition member to an ignition wire tip at the nozzle 50. Many types of spark ignition mechanisms are known in the art. Examples of suitable ignition mechanisms include, but are not limited to, a piezoelectric device, which is preferred in the present embodiment. The ignition wire 28 is shown extending from the ignition source 26 through the flexible support tube 40 to the nozzle head 50. The activation of the ignition means can occur whether the flexible support tube is in the extended or nested position or at positions therebetween. For an illustration of the use of an ignition wire and its relationship to a nozzle refer to U.S. Pat. No. 6,632,082 which is hereby incorporated by reference herein in its entirety. For a relationship between a piezoelectric device and an actuation button refer also to U.S. Pat. No. 6,997,700 which is also hereby incorporated by reference herein in its entirety.

As mentioned before, the actuation button 20 also operates the fuel valve. This is shown schematically in the drawings by the valve 24 that is operated to couple the fuel from the reservoir 14 to the fuel line 30. The fuel line 30 connects through the flexible support tube 40 to the nozzle head 50. As shown in the drawings both the fuel line 30, as well as the piezoelectric wire 28 are formed with a sufficient loop so that they are not pulled or pinched as the flexible support tube transitions between its opposite positions. The hollow flexible support tube 40 is mounted or contained within the hollow guide tube 42. The guide tube 42 extends vertically within the housing 12 and defines an output port 44 through which the flexible support tube 40 extends. The guide tube 42 is provided with a longitudinally extending slot 43 that allows the fuel line 30 and the piezoelectric wire 28 to freely move as the flexible support tube moves between its opposite positions.

Figure 5:
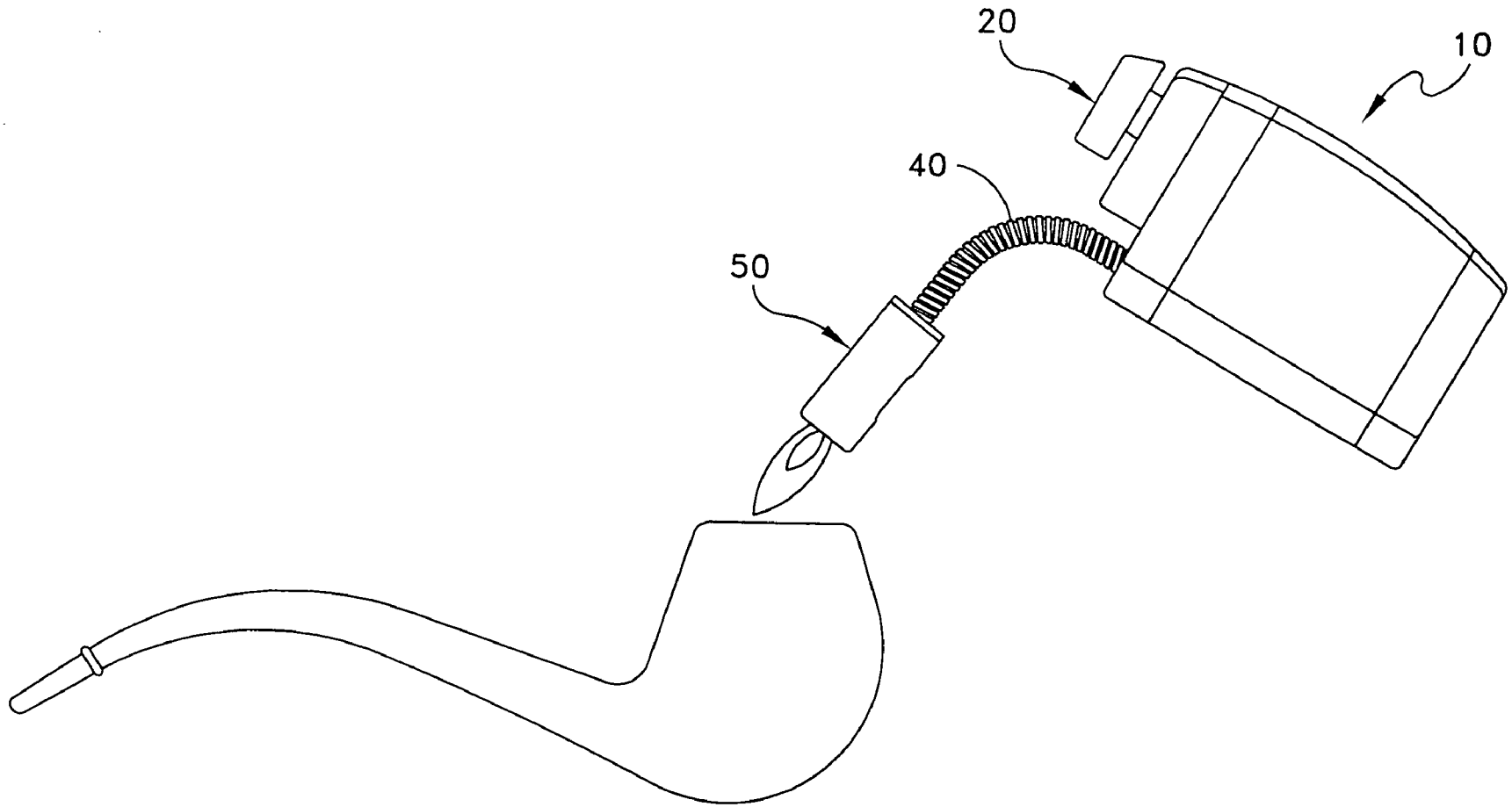
FIG. 5 schematically illustrates the lighter being using for lighting a pipe.
Figure 6:
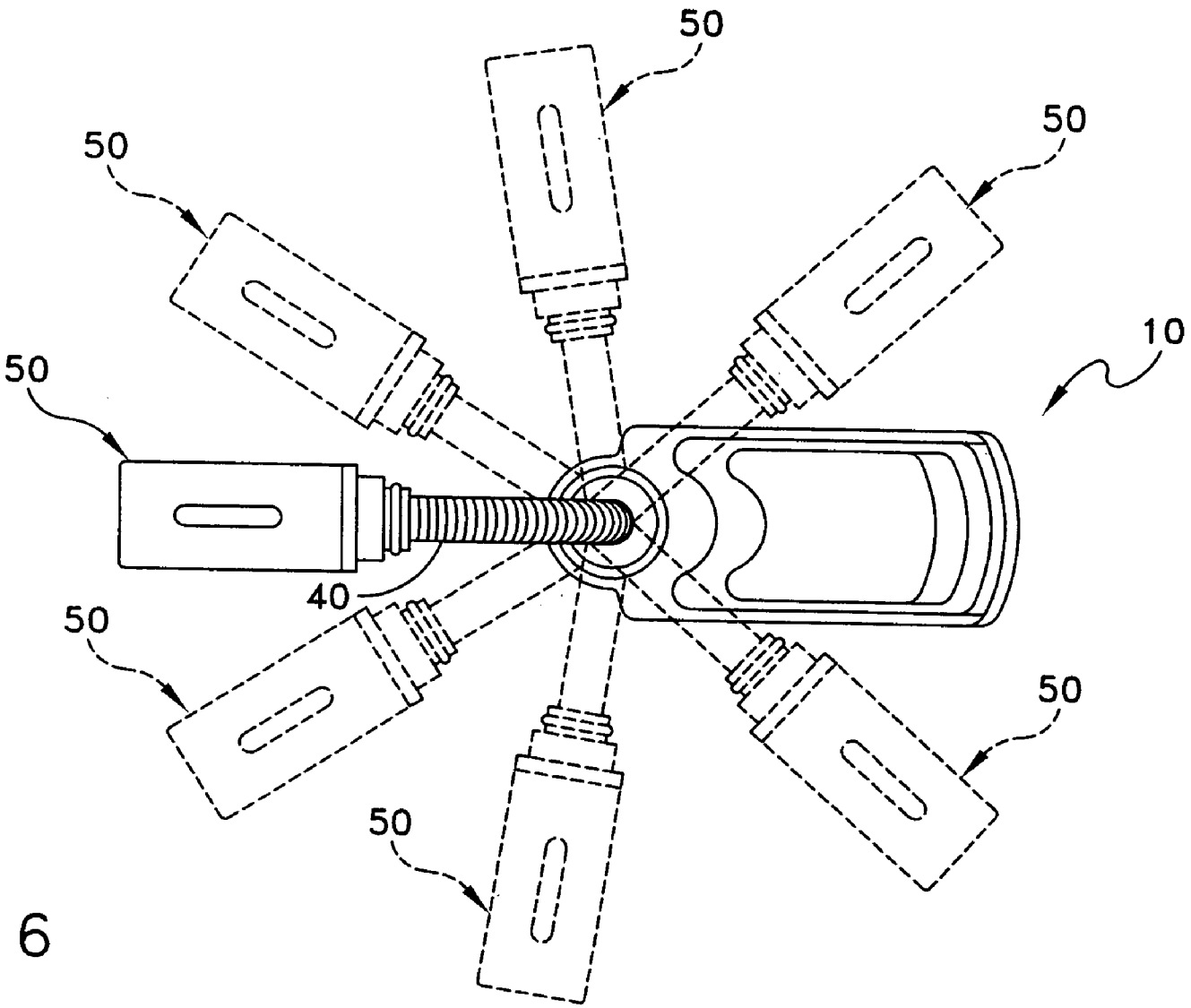
FIG. 6 is a plan view of FIG. 4 illustrating the virtual 360° bending or flexing of the nozzle member.

In the nested position of the flexible support tube 40 the tube is disposed fully within the guide tube 42. Alternatively, in the extended position of the flexible support tube 40, it is fully extended with only the base thereof remaining at the top of the guide tube as illustrated. The flexible support tube 40 is manually nested or inserted and extended relative to its guide tube by grasping the nozzle head, and may also be withdrawn to other positions between fully nested and fully extended. Moreover, the flexible support tube 40 is also capable of bending in about all directions as shown in FIG. 6 in dotted outlines. This bending includes a reverse bend so that the flame can be directed downwardly if need be, as shown in FIG. 5.

Having now described a limited number of embodiments of the present invention, it should now be apparent to those skilled in the art that numerous other embodiments and modifications thereof are contemplated as falling within the scope of the present invention as defined by the appended claims. For example, many different types of lighter constructions are contemplated as falling within the scope of the present invention, such as normal flame lighters as well as torch or windproof lighters. The ignition source can also be of different types.

What is claimed is:

1. A lighter construction comprising:

a housing that contains a fluid reservoir;

a nozzle member;

a fuel line;

a valve disposed in the housing and that selectively couples the fluid reservoir, via the fuel line, to the nozzle member;

an actuation button on said housing at a top wall of the housing;

said nozzle member including a nozzle head;

a piezoelectric device disposed in the housing and for generating a spark at the nozzle head;

an ignition wire that is also disposed in the housing and that connects the piezoelectric device to the nozzle head;

said actuation button operating said piezoelectric device and valve to provide a flame at the nozzle head;

a flexible nozzle tube extendable from said housing and supporting at its distal end said nozzle head;

an elongated hollow guide tube fixedly supported in the housing and for receiving and guiding therein the flexible nozzle tube;

said elongated hollow guide tube having an internal hollow passage for slidably receiving and guiding the flexible nozzle tube as the flexible nozzle tube transitions between nested and extended positions;

an elongated slot in the hollow guide tube for accommodating the ignition wire and the fuel line;

said flexible nozzle tube having a nested position in which the flexible nozzle tube is disposed within said elongated internal hollow passage of said guide tube and an extended position in which the flexible nozzle tube extends from said housing through a top wall housing port and enabling said flexible nozzle tube, in the extended position, to be bent in multiple directions for directing said nozzle head;

wherein the fuel line extends through the flexible nozzle tube from the reservoir to the nozzle head and the ignition wire also that extends through the flexible nozzle tube from the piezoelectric device to a location adjacent to the nozzle head to initiate a flame.

2. The lighter construction of claim 1, wherein the fuel line and ignition wire are both formed with a loop so that ignition wire and fuel line are free to move through the elongated slot as the flexible nozzle tube moves between the nested and extended positions.

3. The lighter construction of claim 2, wherein the elongated slot allows the fuel line and the ignition wire to freely move as the flexible nozzle tube moves between the nested and extended positions.

4. The lighter construction of claim 1 including a flame adjuster and a filler valve at the bottom of the housing.

5. The lighter construction of claim 1 including an elongated guide within the housing for receiving the flexible nozzle tube wherein the fuel line and ignition wire are both formed with a loop so as to enable the flexible nozzle tube to move unimpeded between the nested and extended positions.

6. The lighter construction of claim 1 wherein said flexible nozzle tube comprises a flexible metal tube that is readily bendable through at least 180 degrees.

7. A lighter for lighting and comprising:

a housing that contains a fluid reservoir and an ignition member;

an actuation switch that is disposed on the housing;

a nozzle assembly that includes a nozzle head and a flexible support tube that supports the nozzle head at its distal end;

said flexible support tube extendable from said housing through a housing port;

said flexible support tube having a nested position in which it is disposed within said housing and an extended position in which the flexible support tube extends from said housing through said port enabling said flexible support tube to be bent in multiple directions for directing said nozzle head;

a valve that selectively couples the fluid reservoir to the nozzle assembly via a fuel line;

wherein said actuation switch is operatively connected to both the valve and the ignition member;

wherein the ignition member includes a piezoelectric device and an ignition wire that couples from the piezoelectric device to the nozzle head;

an elongated guide within the housing for receiving the flexible support tube;

and wherein said elongated guide extends between the top and bottom of the housing, has an elongated slot and the nozzle head, in its nested position, is disposed adjacent to the actuation switch;

said elongated slot in the guide accommodating the ignition wire and fuel line.

8. The lighter of claim 7 wherein the fuel line and ignition wire are both formed with a loop so that the ignition wire and fuel line are free to move through the elongated slot as the flexible nozzle tube moves between the nested and extended positions.

9. The lighter of claim 8 wherein the elongated slot allows the fuel line and the ignition wire to freely move as the flexible nozzle tube moves between the nested and extended positions.

10. The lighter of claim 7 wherein the fuel line extends through the flexible support tube from the reservoir to the nozzle head and the ignition wire extends through the flexible support tube from the ignition member to a location adjacent to the nozzle head to initiate a flame.

11. A lighter comprising:

a housing that contains a fluid reservoir and an ignition member;

an actuation switch;

a fuel line;

an ignition wire;

a nozzle assembly that includes a nozzle head and a flexible support tube that supports the nozzle head at its distal end;

an elongated hollow guide within the housing for receiving the flexible support tube;

said fuel line extending through the flexible support tube from the reservoir to the nozzle head and an ignition wire that extends through the flexible support tube from the ignition member to a location adjacent to the nozzle head to initiate a flame;

said flexible support tube having a nested position in which it is disposed within said housing and an extended position in which the flexible support tube extends from said housing enabling said flexible support tube to be bent in multiple directions for directing said nozzle head;

wherein said actuation switch is disposed at a top of the housing and further including a port at the top of the housing adjacent to the actuation switch through which the flexible support tube is extendable, and the guide has a longitudinal slot for accommodating the ignition wire and fuel line.

12. The lighter of claim 11 wherein the fuel line and ignition wire are both formed with a loop so that the ignition wire and fuel line are free to move through the elongated slot as the flexible nozzle tube moves between the nested and extended positions.

13. The lighter of claim 12 wherein the elongated slot allows the fuel line and the ignition wire to freely move as the flexible nozzle tube moves between the nested and extended positions.

14. The lighter of claim 11 including a valve that selectively couples the fluid reservoir to the nozzle assembly via the fuel line.

15. The lighter of claim 11 wherein said actuation switch is operatively connected to both the fluid reservoir and the ignition member, and wherein the ignition member includes a piezoelectric device, said ignition wire coupling from the piezoelectric device to the nozzle.

* * * * *